United States Patent [19]

Cohen

[11] Patent Number: 5,056,714

[45] Date of Patent: Oct. 15, 1991

[54] LOW COST HIGH EFFICIENCY STEAM HEATING SYSTEM

[76] Inventor: Theodore Cohen, 55 Ruxton Rd., Great Neck, N.Y. 11027

[21] Appl. No.: 552,106

[22] Filed: Jul. 13, 1990

[51] Int. Cl.[5] ..... F24D 1/00

[52] U.S. Cl. ..... 237/9 R; 237/67

[58] Field of Search ..... 237/9 R, 7, 6, 2 R, 237/9 A, 8 R, 67; 236/91 F, 46 F

[56] References Cited

U.S. PATENT DOCUMENTS 2,090,073 8/1937 Rohlin .

3,949,936 4/1976 Boyer et al. ..... 237/9 R X

*Primary Examiner*—Henry A. Bennet

*Attorney, Agent, or Firm*—Mark T. Basseches

[57] ABSTRACT

A low cost-high efficiency steam heating system is disclosed. A pressure sensing switch in the radiation device triggers a timer when a predetermined pressure is achieved in the radiator. The timer is interposed between a thermostat and boiler-burner assembly so as to deactivate the boiler-burner for predetermined periods until the set point of the thermostat is reached.

3 Claims, 1 Drawing Sheet

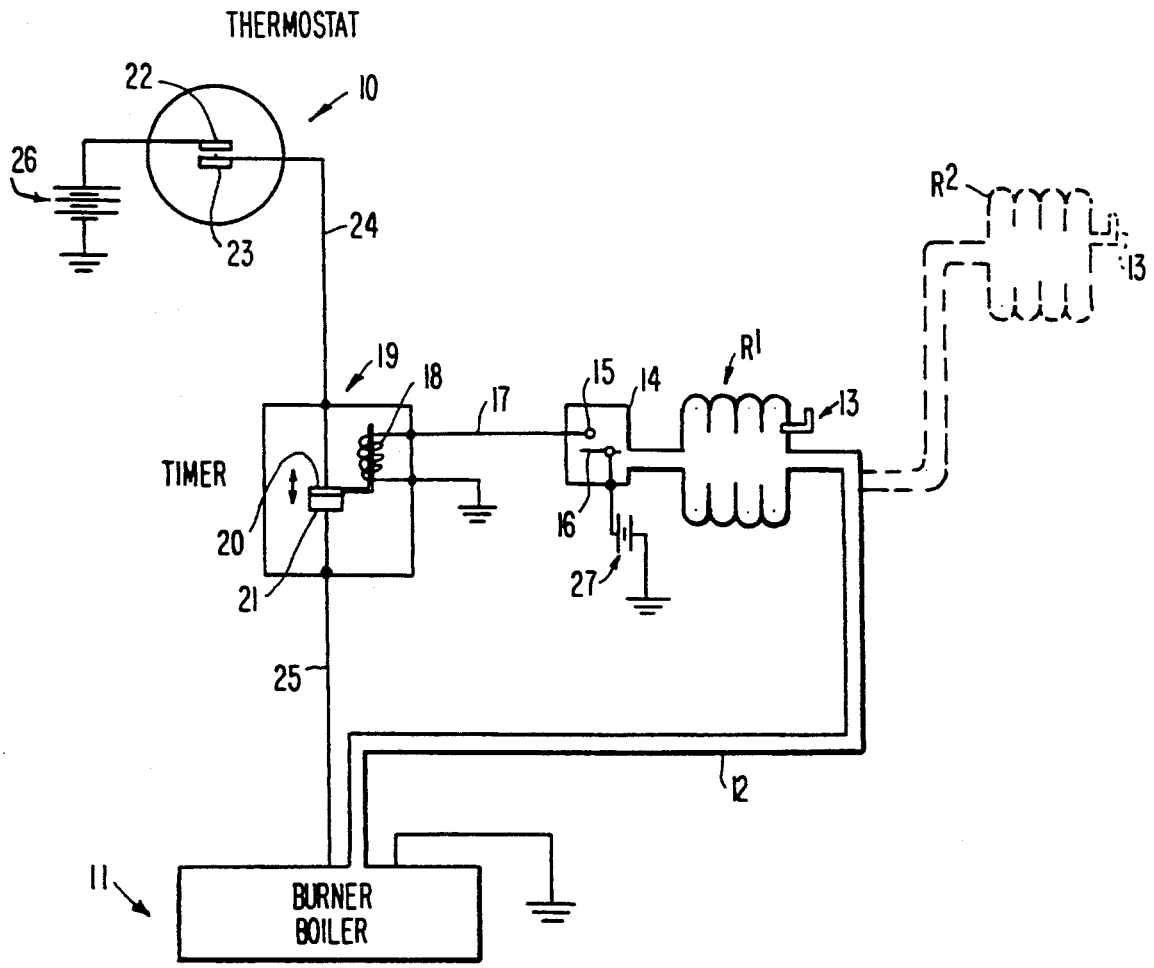
THERMOSTAT
22
10
26
23
24
R2
13
19
18
17
15
14
R1
13
TIMER
20
21
16
27
25
12
11
BURNER
BOILER

LOW COST HIGH EFFICIENCY STEAM HEATING SYSTEM

BACKGROUND OF THE INVENTION

1. Field of the Invention

The present invention is directed to a low cost high efficiency steam heating system, and more particularly to a steam heating system especially adapted to maintain a generally constant temperature in a relatively small space, i.e. in a single zone system using one or more radiators such as may be found in a single dwelling home or apartment.

2. The Prior Art

Conventional steam heating systems of the single dwelling-single zone type are notoriously inefficient in that the temperature in the space is rarely maintained at or near a desired set point. Typical systems of the type described employ a thermostat in the space to be heated which controls a fuel burner, which in turn heats a boiler. Upon a call for heat at the thermostat, steam is generated in the boiler and as the steam pressure increases the steam enters the piping system forcing cool air through the thermostatic vent valves. These valves allow the cool air within the radiators and piping system to vent to the atmosphere and close when steam enters the radiators.

After venting of the air, the hot steam heats the cast iron radiators, which continue to emit heat energy to the space. The burner continues to function until the temperature setting of the thermostat is reached. At this point the burner is deactivated.

A significant drawback of such conventional systems resides in the fact that the radiation equipment will continue to emit heat after the set point is reached and after the burner is deactivated, such residual heat raising the temperature within the space beyond the desired set point. As a result, there is a continuous "hunting" cycle wherein the temperature in the space continuously varies from a temperature below the set point to a temperature above the set point, the higher temperature being developed, as noted, as a result of the continued emission of heat after the set point has been reached.

Numerous control systems have been proposed which incorporate complex valving, multiple sensors etc. in an attempt to provide a relatively constant temperature within one or more spaces to be heated. Such assemblies have heretofore been expensive in view of their complexity, trouble prone, and generally unsuited to simple single zone applications.

Representative examples of prior art control systems include the following:

Patent 1,992,846 relates to a system in which the temperature of the radiator rather than the surrounding space controls the steam supply. Accordingly, the time of steam flow is a function of air temperature surrounding a pilot radiator, rather than purely a function of the condition of the temperature adjacent the thermostat.

Patent 2,468,268 discloses an intermittently fired steam producer in combination with means for heating radiators between cycles, the heating being dependent upon the differential of indoor and outdoor temperatures. When pressure drops due to a high temperature differential, the pressure drop induces a heat flow through the heating circuit even during the off cycle of the boiler.

Other examples of steam heating systems may be found the following additional U.S. Patents:

| | |
|---|---|
| 1,985,215 | (Shivers) |
| 2,030,544 | (Ross) |
| 2,062,565 | (Ferguson et al) |
| 2,065,198 | (Rohlin) |
| 2,152,699 | (Kuester et al) |
| 2,153,382 | (Martin Jr.) |
| 2,249,706 | (Furguson) |
| 2,378,760 | (Furguson) |
| 2,387,576 | (Graves) |
| 2,668,664 | (Williams) |

It is also known, for instance in multi-zone hot water heating systems to provide a boiler which incorporates a temperature control which continually keeps the water at a predetermined temperature irrespective of whether any zone or zones call for heat. In such systems a series of valves and pumps are energized even during off cycles of the boiler to satisfy the needs of respective zones.

Such systems are wasteful of energy since water in the system will be heated even though the temperature in the various zones never goes below the set point of the control thermostats.

SUMMARY OF THE INVENTION

The present invention may be summarized as directed to simple, low-cost steam heating system characterized in that the same is relatively free of "hunting" effects, wherein temperatures in the space to be heated generally vary by significant amounts above and below a desired set point.

Still further, the invention relates to a fuel efficient steam heating assembly especially adapted for use in small single zone spaces to be heated.

In accordance with the invention a conventional heating assembly which includes a boiler, radiation equipment and a thermostat is provided with a pressure sensor adapted to sense pressures in the radiation which exceed atmospheric by a predetermined amount. The pressure sensor is operatively connected to a timer device. When the thermostat calls for heat the boiler is energized and remains functional until the pressure sensor reaches a predetermined pressure level signifying that the radiation has been heated by steam. The pressure sensor in turn energizes the timer which deactivates the burner for a predetermined period, ideally for so long as heat is effectively emitted by the radiator. As a result, efficient use is made of the residual heat in the radiation equipment, rather than necessitating continuous functioning of the boiler until the thermostat set point is reached.

By running the boiler on a series of short cycles as opposed to continuously, as in conventional heating systems, efficient use is made of residual heat in the radiation equipment, and the "hunting" effect is largely avoided.

It is accordingly an object of the invention to provide a simple and highly efficient steam heating assembly, of particular utility in the heating of relatively small homes employing single zones.

A further object of the invention is the provision of a steam heating system of the type described wherein the conventional sequences of under heating and over heating are avoided.

BRIEF DESCRIPTION OF THE DRAWING

In order to attain these objects and such other and further objects as may appear herein or be hereinafter pointed out reference is made to the accompanying drawing depicting schematically a heating system incorporating the invention.

DETAILED DESCRIPTION OF DRAWING

Referring now to the drawing there is schematically depicted a steam heating system in accordance with the invention. The system includes a thermostat 10 a burner-boiler assembly 11 and one or more radiators R1, R2 operatively connected to the burner-boiler 11 as by conduit 12. The radiators R1, R2 include, as is conventional, air vent valves 13.

The master radiator R1 includes in addition pressure sensor switch 14 the contacts 15, 16 of which are normally open but which contacts close when the pressure in the radiator R1 reaches a selected value, i.e. in the range of 0.25 to 0.5 inches of water. Switch contact 15 is connected via conduit 17 to the activating coil 18 of timer device 19. The timer device includes switch contacts 20, 21 which are normally closed. When coil 18 is energized the contacts 20,21 will open for a selected time period which may be varied in known manner by adjustment of the timer mechanism.

Thermostat 10 includes contacts 22,23 which close when the temperature surrounding the thermostat falls below the set point, the contacts of the thermostat being open when the temperature surrounding the thermostat is at or above the set point.

The thermostat is connected via conduit 24 to contact 20 of the timer device, contact 21 of the timer device being connected via conduit 25 to the burner-boiler assembly.

OPERATION

The operation of the device will be apparent from the preceding description. When the thermostat 10 calls for heat (contacts 22,23 closed) current from current source 26 flows through conduit 24 through the normally closed contacts 20,21, through conduit 25 to energize the boiler-burner.

As steam is generated and flows through conduit 12 to the radiators R1,R2 the air within the radiators is driven to the atmosphere through valves 13. Steam pressure will now rise in the radiators R1,R2 until such pressure is sufficient to close the contacts 15, 16 of pressure switch 14. When contacts 15, 16 are closed, current from current source 27 flows through conduit 17 leading to the coil 18 of timer device 19 triggering the timer device which thereupon causes contacts 20,21 to open interrupting the current flow to the burner boiler assembly 11 thus shutting off the burner for a selected time period. So long as the set point of thermostat 10 has not been reached, the cycle will be repeated, i.e. after the "off" period of the timer has elapsed timer contacts 20.21 will close and the burner will again be energized until the pressure switch reactivates the timer to de-energize the boiler for a preset period.

Preferably, the timer device is of the type which permits the "open" period of contacts 20 and 21 to be varied by the occupant, the ideal cycling periods to be determined with a minor amount of trial and error experimentation.

Ideally, the cycling period should be set such that the burner will remain in the off or inactive position for a period of time equivalent to a time required for the radiation equipment to lose the majority of the residual heat stored in the radiators. It will be appreciated that the contacts 15,16 of pressure sensor switch 14 will normally open within a short period of time following deactivation of the burner-boiler 11 due to pressure drop, but that such opening will not re-energize the boiler during the period that contacts 20,21 are kept open by the timer.

When the set point of the thermostat has been reached, the thermostat contacts 22, 23 will open ending the heating cycle described until the temperature again falls to a point below the set point.

From the foregoing it will be appreciated that there is provided with accordance with the invention a simple yet effective system for controlling the temperature in a steam heated space in a manner which maximizes fuel efficiency and minimizes cycles of continued overheating and underheating. The control apparatus employs readily available components and is easily adaptable to retrofit existing heating systems with a minimum of additional parts. The system permits the occupant to tailor the on/off cycle of the timer for desired sequential periods in accordance with varying ambient conditions, i.e. shorter "off" cycle of the timer may be appropriate in the middle of the winter whereas longer "off" periods may be desired in the late Fall or early Spring.

As will be apparent to those skilled in the art and familiarized with the instant disclosure, numerous variations in details of construction may be made without departing from the spirit of the invention. Accordingly, the same is to be broadly construed within the scope of the appended claims.

I claim:

1. A high efficiency steam heating system for controlling the temperature in a space to be heated comprising a boiler, a radiator in said space to be heated, steam conduit means operatively connecting said boiler and radiator, a thermostate in said space to be heated said thermostat being operatively connected to said boiler to initiate a heating cycle responsive to a sensed temperature below a predetermined temperature in said space, pressure sensor means in communication with said radiator for sensing super-atmospheric pressures in said radiator of a predetermined magnitude, and timer means adapted to be energized by said sensor means responsive to sensing of said super atmospheric pressures for deactivating said boiler for a predetermined time period whereby said boiler is cyclically energized and de-energized until said predetermined temperature is reached.

2. A system in accordance with claim 1 wherein said timer means includes means for varying the off periods of said boiler.

3. A system in accordance with claim 1 wherein said pressure sensor means is activated responsive to sensed pressures of the magnitude of from about 0.2 to about 0.5 inches of water.

* * * * *